US007847239B2

(12) United States Patent
Lu et al.

(10) Patent No.: US 7,847,239 B2
(45) Date of Patent: Dec. 7, 2010

(54) CALIBRATION STRIP AND THE LASER CALIBRATION SYSTEM USING THEREOF

(75) Inventors: Shao-Chuan Lu, Taichung (TW); Min-Kai Lee, Tainan County (TW); Sung-Ho Liu, Kaohsiung (TW)

(73) Assignee: Industrial Technology Research Institute, Hsin-Chu (TW)

( * ) Notice: Subject to any disclaimer, the term of this patent is extended or adjusted under 35 U.S.C. 154(b) by 8 days.

(21) Appl. No.: 12/055,208

(22) Filed: Mar. 25, 2008

(65) Prior Publication Data

US 2009/0139297 A1 Jun. 4, 2009

(30) Foreign Application Priority Data

Nov. 30, 2007 (TW) ..... 96145525 A

(51) Int. Cl.
*G12B 13/00* (2006.01)

(52) U.S. Cl. ..... 250/252.1

(58) Field of Classification Search ..... 250/252.1, 250/458.1, 492.1, 492.2, 504 R; 73/1.01
See application file for complete search history.

(56) References Cited

U.S. PATENT DOCUMENTS

| | | | | |
|---|---|---|---|---|
| 4,557,599 | A | 12/1985 | Zimring | |
| 5,895,928 | A * | 4/1999 | Kerschner | 250/559.37 |
| 5,902,246 | A * | 5/1999 | McHenry et al. | 600/476 |
| 6,472,671 | B1 * | 10/2002 | Montagu | 250/458.1 |
| 6,501,061 | B1 | 12/2002 | Kitai et al. | |
| 7,586,590 | B2 * | 9/2009 | Baskeyfield et al. | 356/42 |
| 2002/0100863 | A1 * | 8/2002 | Spears | 250/208.1 |
| 2007/0032896 | A1 | 2/2007 | Ye et al. | |
| 2007/0241274 | A1 * | 10/2007 | Chang et al. | 250/252.1 |
| 2008/0016941 | A1 * | 1/2008 | Tisserand et al. | 73/1.89 |

FOREIGN PATENT DOCUMENTS

TW I270742 1/2007

OTHER PUBLICATIONS

Chinese Patent Office examination report No. 096145525, Jul. 27 2010, China.

* cited by examiner

*Primary Examiner*—David P Porta
*Assistant Examiner*—Faye Boosalis
(74) *Attorney, Agent, or Firm*—WPAT, PC; Justin King

(57) ABSTRACT

A calibration strip and a laser calibration system using thereof are disclosed. The calibration strip is comprised of: a substrate; and a light impermissible layer, having a calibration pattern formed thereon while being formed on the substrate. The light impermissible layer is an opaque layer, being formed on the surface of the substrate by coating, electroplating or adhering. The substrate, manufactured by the principle for enabling the color or brightness of the substrate to have high contrast comparing with those of the light impermissible layer, can be a structure of a layer of transparent material and a light source; a layer of transparent material and a backlight source; or a metal film having a reflective layer formed thereon. Since, in the laser calibration system, the calibration strip with the calibration pattern is imaged by an imaging device and then the captured image is send to a processing unit where it is analyzed, the time-consuming and inaccurate off-line manual calibration is no longer required and the laser calibration system can be adapted for various lasers regardless of their spectra.

19 Claims, 6 Drawing Sheets

CALIBRATION STRIP AND THE LASER CALIBRATION SYSTEM USING THEREOF

FIELD OF THE INVENTION

The present invention relates to a calibration strip and the laser calibration system using thereof.

BACKGROUND OF THE INVENTION

In conventional laser scanning, feature deformations such as distortion and skew are very common. There are three kinds of distortion for example, any of which may be present in an optical unit: pillow-shaped distortion, in which magnification increases with distance from the axis as shown in FIG. 1A; barrel distortion, in which magnification decreases with distance from the axis as shown in FIG. 1B; and barrel-pillow-shaped distortion, being the combination of the pillow-shaped and the barrel-shaped deformation as shown in FIG. 1C. Thus, it is required to perform a calibration process upon the laser machining apparatus for compensating such errors.

As we see currently in the industries, the laser machining errors are usually being calibrated and adjusted by a manual operation. Please refer to FIG. 2A and FIG. 2B, which schematic diagrams respectively showing a conventional laser calibration strip having a square pattern of 12×12 dot matrix formed thereon and showing the conventional calibration strip of FIG. 2A being laser machined and thus having a distorted pattern formed thereon. As shown in FIG. 2A and FIG. 2B that the calibration pattern 71 formed on the conventional calibration strip 70 is a square pattern of 12×12 dot matrix and the distorted pattern 72 is a pillow-shaped distortion, it is possible to measure the laser machining error between the distorted pattern 72 and the calibration pattern 71 manually by the use of a measurement tool such as a ruler. Please refer to FIG. 3, which is a flow chart depicting steps for compensating the laser machining error. In FIG. 3, the flow starts at step 91, in which a calibration table is generated according the a manual measurement operation shown in FIG. 2B and then the so-generated calibration table is fed to a conversion program to be converted; and then the flow proceeds to step 92. At step 92, a calibration file recognizable by a control card is generated from the conversion of the conversion program that is transmitted to the control card; and then the flow proceeds to step 93. At step 93, the control card is going to perform a distortion compensation process according to the calibration file.

However, the aforesaid method for calibrating laser machining error has the following shortcomings:

(1) As a calibration strip made of a specific material is only suitable for calibrating a laser of a specific wavelength, various calibration strips made of different materials are required.

(2) For facilitating the manual measurement, it is preferred to use a laser of larger power to form a more distinguishable distorted pattern. However, the large-powered laser can inflict more severe thermal deformation upon the calibration strip and thus adversely affected the accuracy of the measurement.

(3) The manual measurement and calibration is a time consuming work if there are too many dots in the dot matrix of the calibration pattern, e.g. when there are more than 256 dots existed in the calibration pattern.

There are already many studies trying to improve the aforesaid shortcomings. One of which is disclosed in U.S. Pat. No. 6,501,061, entitled "Laser calibration apparatus and method", which shows a system for positioning a focused laser beam over a processing area with high precision by the detection of a charge coupled device (CCD). It is an on-line calibration method that is basically performed by the use of: a laser scanner having scanner position coordinates for scanning the focused laser beam over a region of interest on a work surface; a CCD for detecting when the focused laser beam is received at the work surface. As a specific CCD can only detects laser beams of wavelength in a specific range, the aforesaid apparatus must be provided with various CCDs so as to be used for detecting laser beams ranged from 248 nm to 10.6 μm. It is noted that the aforesaid apparatus can be very costly especially when a CCD for detecting laser beam in an invisible wavelength range is required, as such CCD can be 5 times to 10 times more expensive than other common CCDs. Moreover, the energy of the laser beams used in the aforesaid apparatus must be decayed before it is detected by the CCD.

As in many laser processing applications, it is necessary to position a focused laser beam over a processing area with very high precision. Therefore, a rapid and accurate on-line laser calibration apparatus is becoming a necessity for mass production.

SUMMARY OF THE INVENTION

The object of the present invention is to provide a calibration strip and a laser calibration system thereof, that can be used for calibrating the deformation of a laser scanned pattern in a rapid and accurate manner.

To achieve the above object, the present invention provides a calibration strip adapted for a laser calibration system, comprising: a substrate; and a light impermissible layer, having a calibration pattern formed thereon while being formed on the substrate; in which the light impermissible layer is an opaque layer, being formed on the surface of the substrate by coating, electroplating or adhering; the substrate, manufactured by the principle for enabling the color or brightness of the substrate to have high contrast compared with those of the light impermissible layer, and can be a structure of a layer transparent material and a light source, a layer of transparent material and a backlight source, or a metal film having a reflective layer formed thereon; and in the laser calibration system, the calibration strip with the calibration pattern is imaged by an imaging device and then the captured image is send to a processing unit where it is analyzed.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are for illustration purposes; and thus are not limiting of the scope and content of the present invention wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1A:
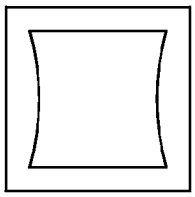
FIG. 1A to FIG. 1C are schematic diagrams showing various types of laser machining distortions.
Figure 1B:
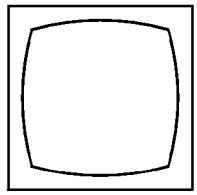
Figure 1C:
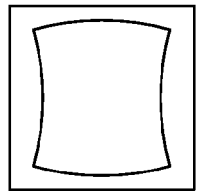
Figure 2A:
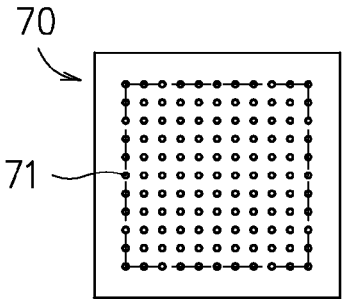
FIG. 2A (PRIOR ART)
FIG. 2A is a schematic diagram showing a conventional laser calibration strip having a square pattern of 12×12 dot matrix formed thereon.
Figure 2B:
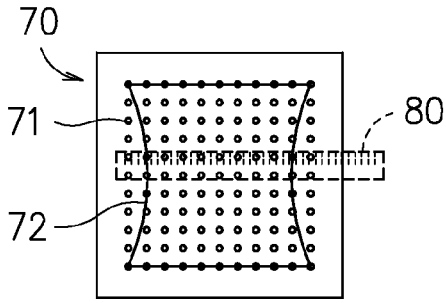
FIG. 2B (PRIOR ART)
FIG. 2B is a schematic diagram showing the conventional calibration strip of FIG. 2A being laser machined and thus having a distorted pattern formed thereon.
Figure 3:
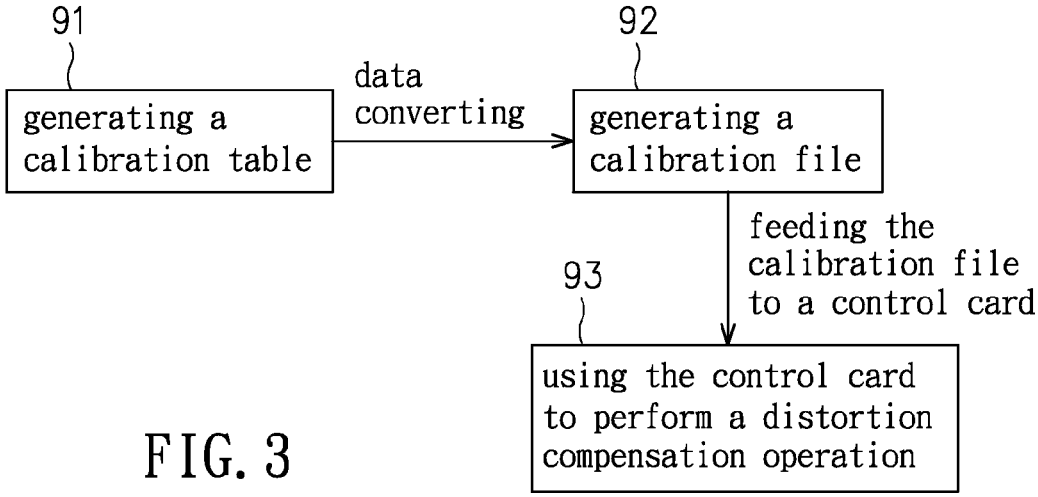
FIG. 3 is a flow chart depicting steps for compensating the laser machining error.
Figure 4:
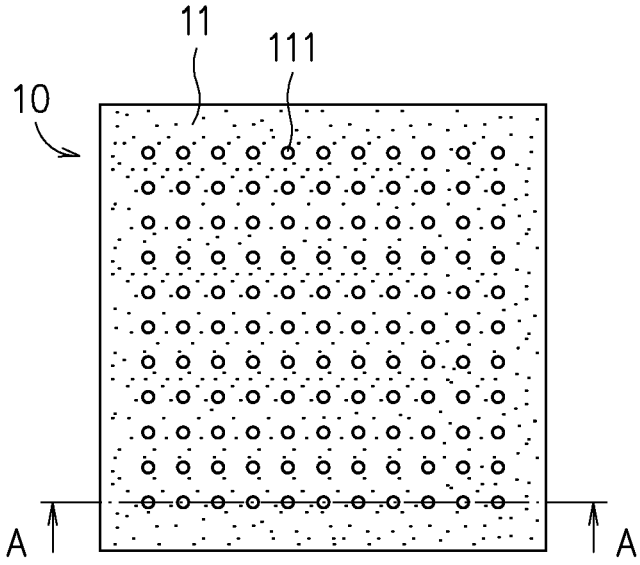
FIG. 4 is a schematic diagram showing a calibration strip according to an exemplary embodiment of the invention.
Figure 5:
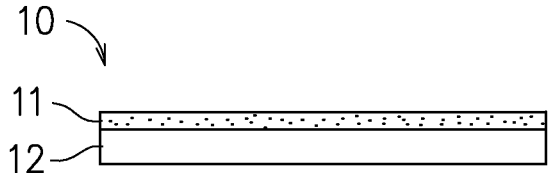
FIG. 5 is a side view of FIG. 4.
Figure 6:
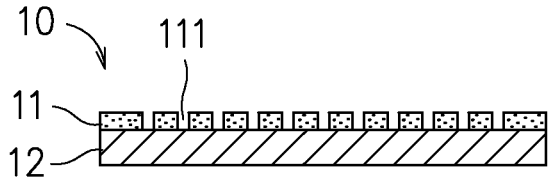
FIG. 6 is an A-A cross sectional view of FIG. 4.

Please refer to FIG. 4 to FIG. 6, which show a calibration strip according to an exemplary embodiment of the invention. The calibration strip 10 comprises a light impermissible layer 11 and a substrate 12, in which the light impermissible layer 11 has a calibration pattern formed thereon. In this exemplary embodiment, the light impermissible layer is formed on a surface of the substrate 12 by coating, electroplating or adhering as a film with almost no light reflectivity. Each dot 111 of the calibration pattern 11 is formed by a means of laser processing. As the substrate 12 is disposed at the bottom of the light impermissible layer 11, it can be made from a transparent film, such as acrylic or glass; or can be stacked with at least two layers of transparent film; or can be a glass or acrylic film having a layer of polymer formed thereon by coating, electroplating or adhering; or can be made from a metal film of high reflectivity such as stainless steel, iron or aluminum; or can be stacked with at least two high reflective layers while each layer of the stack is manufactured from a film having at least one layer of high reflective material formed thereon by a means selected from the group consisting of coating, electroplating and adhering.

In FIG. 6, as the substrate 12 is made of a transparent material and the light impermissible layer 11 is a film with almost no light transmittance, the color and brightness of the two are highly contrasted. In addition, as each dot 111 is formed as a hole etching through the whole light impermissible layer 11, the color and brightness corresponding to each dot 111 can appear to be highly contrasted with those of its neighboring light impermissible layer 11. Thus, such calibration strip with calibration pattern 11 of high contrast can be used in a laser calibration system. It is noted that the light impermissible layer 11 is very thin that its thickness is no larger than 2 mm. The light impermissible layers 11 shown in the figures are only illustrations with exaggerated thickness for the benefit of obviousness. Moreover, as each dot 111 is formed by removing the portion of the light impermissible layer 11 corresponding to the dot 111 using a means of laser processing, it is preferred and also will be sufficient to use low-energy laser beam for processing the dots 111 for preventing severe thermal deformation to be caused upon the calibration strip and thus adversely affected the accuracy of the measurement. Last but not least, the dots 111 in the aforesaid embodiment are arranged as an array of regular shape, however, it is not limited thereby that the calibration pattern can be constructed on the light impermissible layer 11 in a shape selected from the group consisting of a regular geometrical shape and a irregular geometrical shape, each composed of any numbers of components selected from the group consisting of dots, lines and arcs. For instance, if each component of the calibration pattern is selected to be a dot, those dots can be arranged as a symmetrical array of a circular shape, a square shape, a rectangle shape or even a crisscross shape.

Figure 7:
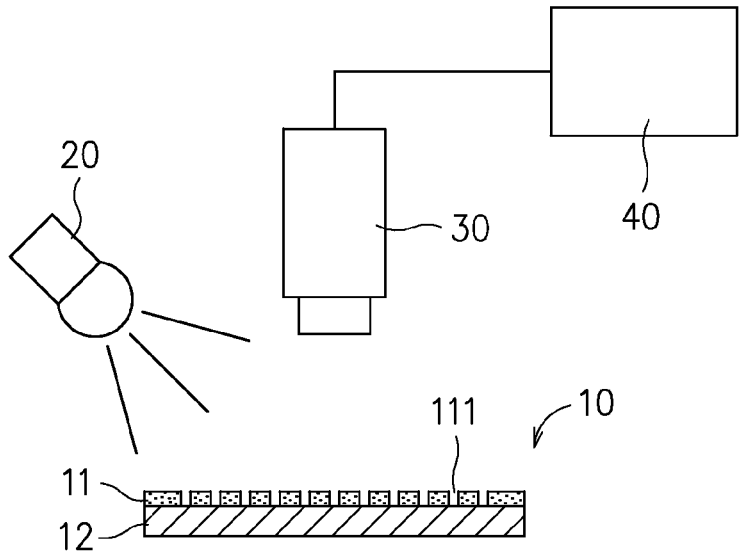
FIG. 7 is a schematic diagram showing a laser calibration system according to an exemplary embodiment of the invention.

Please refer to FIG. 7, which is a schematic diagram showing a laser calibration system according to an exemplary embodiment of the invention. In FIG. 7, the laser calibration system comprises: a calibration strip 10, a light source 20, at least an imaging device 30 and a processing unit 40. The light source 20 is used for illuminating the top surface of the calibration strip 10, i.e. the light emitted from the light source is directed to shine on the light impermissible layer 11. It is noted that the disposition of the light source 20 is dependent upon actual requirement. That is, when there is enough ambient illumination, there can be no light source 20 to be arranged in the laser calibration system; or when there is no sufficient ambient illumination or the area of the calibration strip used in the laser calibration system is large, there can be more than one light sources 20 to be arranged in various locations in the laser calibration system. It is noted that the light source 20 can be a coaxial light source or a sideway illuminating light source. The imaging device 30 is used for capturing images of the calibration strip 10 and it can be a surface or line imaging device that can capture images at any direction. In this exemplary embodiment, the imaging device 30 is orientated toward the light impermissible layer 11 of the calibration strip 10. Operationally, the imaging device 30 can be an integrated device composed of a plurality of cameras which are mounted on corresponding movable carriers, such that the plural shots taken from the plural cameras can be combined into an image of high resolution to be processed by the processing unit 40.

Figure 8:
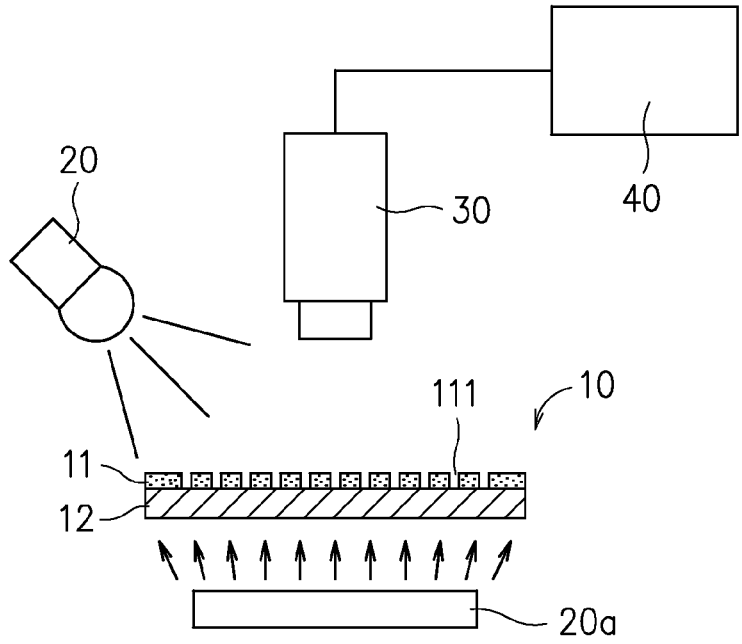
FIG. 8 is a schematic diagram showing a laser calibration system according to another exemplary embodiment of the invention.

Please refer to FIG. 8, which is a schematic diagram showing a laser calibration system according to another exemplary embodiment of the invention. The laser calibration system of FIG. 8 is comprised of: a calibration strip 10, a light source 20, at least an imaging device 30 and a processing unit 40, which are similar to those shown in FIG. 7 and thus are not described further herein. The present embodiment is characterized in that: there is an additional light source 20*a* to be placed under the calibration strip 10, and thus, the contrast of the dots 111 formed on the calibration strip 10 can be further enhanced and optimized by adjusting the brightness of the two light sources 20, 20*a*. Similarly, there can be a plurality of light sources 20*a* arranged at different locations in the laser calibration system. It is emphasized that only the substrate 12 made of transparent material is suitable to be used in the present embodiment of FIG. 8 while those made of metal film is not. In addition, as there is at least a light source 20*a* disposed under the calibration strip 10, the light source 20 positioned over the calibration strip 20 might not be necessary and thus can be cancelled.

Figure 9:
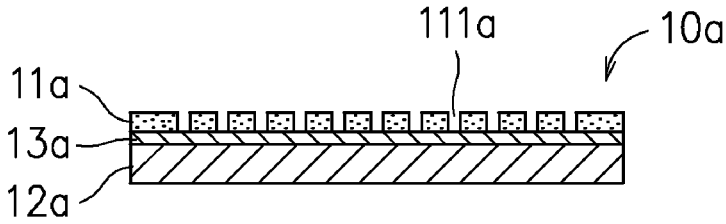
FIG. 9 to FIG. 11 are cross sectional views of different calibration strips of the invention.
Figure 10:
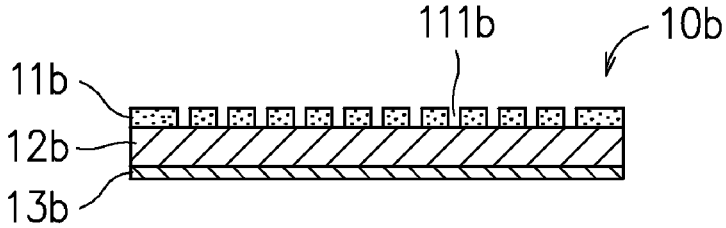
Figure 11:
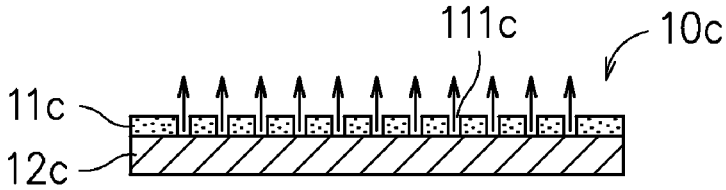

Please refer to FIG. 9 to FIG. 11, which are cross sectional views of different calibration strips of the invention. In FIG. 9, the calibration strip 10*a* comprises: a light impermissible layer 11*a* having a plurality of hollow dots 111*a* formed thereon; and a substrate 12*a*, and is characterized in that: there is a reflective layer 13*a* sandwiched between the light impermissible layer 11*a* and the substrate 12*a*, which is used for enhancing the contrast of the dots 111*a* that the reflective layer 13*a* is formed by coating, electroplating or adhering. In FIG. 10, the calibration strip 10*b* also comprises: a light impermissible layer 11*b* having a plurality of hollow dots 111*b* formed thereon; and a substrate 12*b*, and is characterized in that: there is a reflective layer 13*b* disposed at the bottom of the substrate 12*b* for enhancing the contrast of the dots 111*b* that the reflective layer 13*b* is formed by coating, electroplating or adhering. It is noted that as the reflective layer 13*b* is formed at the bottom of the substrate 12*b*, the substrate 12*b* made of metal film of no light transmittance is not suitable to be used in this embodiment. In FIG. 11, the calibration strip 10*c* also comprises: a light impermissible layer 11*c* and a substrate 12*c*, and is characterized in that: the substrate 12*c* is constructed as a light emitting device, such as a backlight module or an electroluminescent (EL) light source. It is noted that the substrate 12*c* is manufactured from a light-emitting film with at least two stacking layer, the film having at least a layer of light emitting material formed thereon by a means selected from the group consisting of coating, electroplating and adhering. As the substrate 12*c* can emit light to the light impermissible layer 11*c* and travel passing the same through the dots 111*c*, the contrast of the dots is enhanced. It is noted that all the calibration strips shown in FIG. 9 to FIG. 11 can be used in the laser calibration systems of FIG. 7 and FIG. 8.

Figure 12:
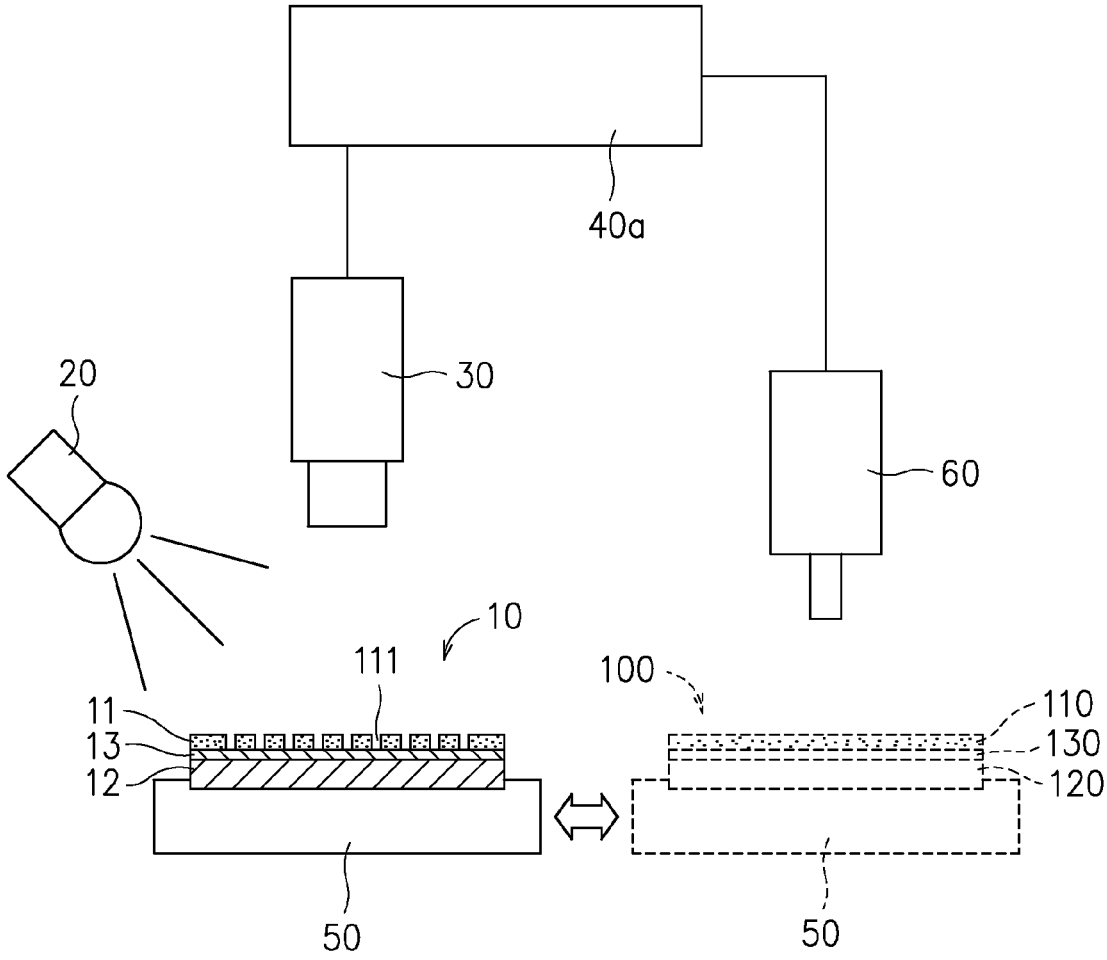
FIG. 12 is a schematic diagram showing a laser calibration system according to yet another exemplary embodiment of the invention.

Please refer to FIG. 12, which is a schematic diagram showing a laser calibration system according to yet another exemplary embodiment of the invention. The laser calibration system of FIG. 12 is comprised of: a calibration strip 10, a light source 20, at least an imaging device 30 and a processing unit 40*a*, which are similar to that shown in FIG. 7 and thus are not described further herein. The present embodiment is characterized in that: the calibration strip 10 is mounted on a movable carrier 50. As the calibration pattern, i.e. the dots 111, of the calibration strip 10 is formed by a means of laser processing, the laser calibration system of the present embodiment has a laser device 60 to be placed at a location correspondingn to the moving path of the movable carrier 50 for enabling the laser devie to process the calibration strip 10. First, a calibration strip 100 that is not processed by the laser device 60 is being mounted on the movable carrier 50, whereas the calibration strip 10 is comprised of: a light impermissible layer 110; a substrate 120; and a reflective layer sandwiched between the light impermissible layer 110 and the substrate 120. Thereby, when a production platform requires to be calibrated, the calibration strip 100 will be move to the laser device 60 where it is scanned and thus a portion of the light impressible layer 110 is removed, marking the distribution with respect to the scanning error on the calibration strip 100. Thus, the imaging device is activated to capture images of the scanned calibration strip 100 and then the captured images are send to the processing unit 40*a* where they are analyzed. It is noted that the image capturing of the imaging device 30, the moving of the movable carrier 50, and the laser processing of the laser device 60 are all controlled by the processing unit 40*a*. As there is a laser device 60 incorporated in the system of the aforesaid embodiment, laser scan error can be compensated in an on-line and real-time manner and thus not only the reliability of mass production is enhanced, but also the stability of processing is increased since it is possible to enforce a periodical calibration upon the production platform by the help of the carrier 50.

The advantage of the present invention can be illustrated in the following table:

| | Calibration strip | Measurement method | Time required for measuring the compensation | Measurement accuracy |
|---|---|---|---|---|
| Present invention | being comprised of highly contrasted substrate and light impressible layer | Compensation is measured visually in an automatic manner | For a 25 × 25 array, the time required in less than 2 seconds | For a 640 × 480 pixel CCD, the accuracy is less than 300 μm |
| Prior art | manufactured from a film of stainless steel, acrylic, plastic or ivory board | Compensation is measured in a manual manner | For a 25 × 25 array, the time required in less than 60 minutes | the error is about 0.8~1 mm |

Figure 13:
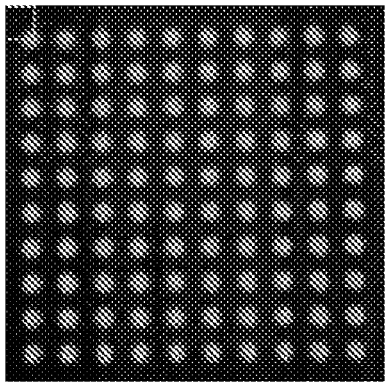
FIG. 13 shows an acrylic calibration strip of the invention after it is processed by a laser beam of 1064 nm wavelength.
Figure 14:
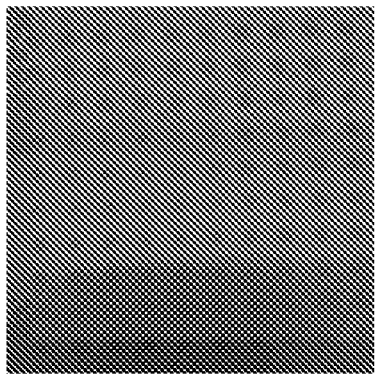
FIG. 14 shows a stainless steel calibration strip of the invention after it is processed by a laser beam of 1064 nm wavelength.
Figure 15:
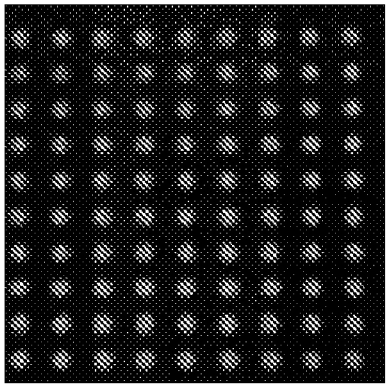
FIG. 15 shows an acrylic calibration strip of the invention after it is processed by a laser beam of 10600 nm wavelength.
Figure 16:
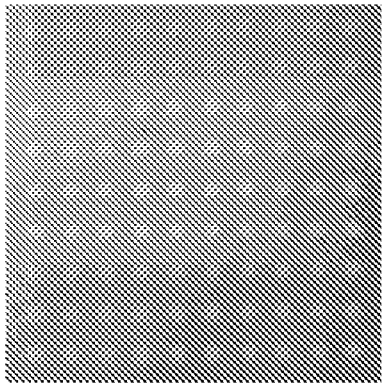
FIG. 16 shows a conventional acrylic calibration strip after it is processed by a laser beam of 10600 nm wavelength.

Please refer to FIG. 13 and FIG. 14, which respectively show an acrylic calibration strip of the invention after it is processed by a laser beam of 1064 nm wavelength, and a stainless steel calibration strip of the invention after it is processed by a laser beam of 1064 nm wavelength. In addition, please refer to FIG. 15 and FIG. 16, which respectively show an acrylic calibration strip of the invention after it is processed by a laser beam of 10600 nm wavelength, and a conventional acrylic calibration strip after it is processed by a laser beam of 10600 nm wavelength. From the above comparison, it is noted that the calibration strip can be adapted for laser beams of various wavelengths. In addition, it is known from the above experiments, the contrast represented in the calibration strips of the invention is enhanced and thus the dots of the calibration pattern are much more identifiable.

To sum up, the present invention provides a calibration strip and a laser calibration system using thereof, capable of calibrating the deformation of a laser scanned pattern in a rapid and accurate manner that it is free from the sluggish of the conventional off-line manual calibration and can be adapted for laser beams of various wavelengths. In addition, by incorporating the same with a movable carrier, the stability of laser processing is increased since it is possible to enforce a periodical calibration upon the production platform.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A calibration strip, comprising:

a substrate; and a light impermissible layer on the substrate, having a calibration pattern thereon while being formed on said substrate;

the calibration strip having a color/brightness to enables a high contrast between said substrate and said light impermissible layer when illuminated by a light emitting device;

said light emitting device is manufactured from a film with two stacking layers, the film having a layer of light emitting material formed thereon by a means selected from the group consisting of coating, electroplating, and adhering, and the calibration pattern is constructed in a shape selected from the group consisting of a regular geometrical shape and an irregular geometrical shape, each composed of any number of components selected from the group consisting of dots, lines, and arcs.

2. The calibration strip of claim 1, wherein the light impermissible layer is an opaque layer, being formed on the surface of the substrate by a means selected from the group consisting of coating, electroplating and adhering.

3. The calibration strip of claim 1, wherein the substrate is manufactured from a structure selected from the group consisting of: a transparent film and a stacking of at least two layers of transparent films.

4. The calibration strip of claim 1, wherein the light source is a backlight source.

5. The calibration strip of claim 1, wherein the substrate is manufactured from a structure selected from the group consisting of: a layer of high reflective material and a stacking of at least two layers of high reflective materials.

6. The calibration strip of claim 5, wherein each layer of the stacking is manufactured from a film having at least one layer of high reflective material fromed thereon by a means selected from the group consisting of coating, electroplating, and adhering.

7. The calibration strip of claim 1, wherein the substrate is substantially a light emitting device.

8. The calibration strip of claim 1, wherein the calibration pattern is constructed in a shape selected from the group consisting of a regular geometrical shape and an irregular geometrical shape, each composed of any number of components selected from the group consisting of dots, lines and arcs.

9. The calibration strip of claim 8, wherein the calibration pattern is an array of dots arranged in a symmetrical shape selected from the group consisting of: circular shapes, square shapes, rectangle shapes and crisscross shapes.

10. A laser calibration system, comprising:

a substrate; and a light impermissible layer on the substrate, having a calibration pattern thereon while being formed on said substrate;

the calibration strip having a color/brightness to enables a high contrast between said substrate and said light impermissible layer when illuminated by a light emitting device;

said light emitting device is manufactured from a film with two stacking layers, the film having a layer of light emitting material formed thereon by a means selected from the group consisting of coating, electroplating, and adhering, and the calibration pattern is constructed in a shape selected from the group consisting of a regular geometrical shape and an irregular geometrical shape, each composed of any number of components selected from the group consisting of dots, lines, and arcs.

11. The laser calibration system of claim 10, wherein the light impermissible layer is an opaque layer, being formed on the surface of the substrate by a means selected from the group consisting of coating, electroplating and adhering.

12. The laser calibration system of claim 10, wherein the substrate is made of transparent material.

13. The laser calibration system of claim 10, wherein the substrate is made of a high reflective material.

14. The laser calibration system of claim 13, wherein the substrate is manufactured from a stacking of at least two high reflective layers while each layer of the stacking is manufactured from a film having a high reflective layer formed thereon by a means selected from the group consisting of coating, electroplating and adhering.

15. The laser calibration system of claim 10, wherein the substrate is substantially a light emitting device.

16. The laser calibration system of claim 10, wherein the calibration pattern is an array of dots arranged in a symmetrical shape selected from the group consisting of: circular shapes, square shapes, rectangle shapes and crisscross shapes.

17. The laser calibration system of claim 10, further comprising a light source, for illuminating the calibration strip.

18. The laser calibration system of claim 10, further comprising a plurality of light sources, disposed in a manner that one of the plural light sources is oriented for directing the light emitted therefrom to shine on the light impermissible layer of the calibration strip while enabling the others to shine on the substrate.

19. The laser calibration system of claim 10, wherein the calibration strip is mounted on a movable carrier while placing a laser device at a location corresponding to the moving path of the movable carrier for enabling the laser device to process the calibration strip.

* * * * *